US005952785A

United States Patent [19]

Komm et al.

[11] Patent Number: 5,952,785

[45] Date of Patent: Sep. 14, 1999

[54] TRANSVERSE FIELD COLLECTOR FOR A TRAVELING WAVE TUBE

[76] Inventors: David S. Komm, 1814 Shilling Ct., Torrance, Calif. 90501; Xiaoling Zhai, 2712 Portobello Dr., Torrance, Calif. 90505

[21] Appl. No.: 08/896,102

[22] Filed: Jul. 17, 1997

[51] Int. Cl.[6] ..... H01J 23/027; H01J 25/34

[52] U.S. Cl. ..... 315/3.5; 315/5.38

[58] Field of Search ..... 315/5.38, 3.5

[56] References Cited

U.S. PATENT DOCUMENTS

| | | | |
|---|---|---|---|
| 3,202,863 | 8/1965 | Dunn et al. | 315/5.38 |
| 3,993,925 | 11/1976 | Achter et al. | 315/5.38 |
| 4,096,409 | 6/1978 | Hechtel | 315/5.38 |
| 4,794,303 | 12/1988 | Hechtel et al. | 315/5.38 |

FOREIGN PATENT DOCUMENTS

| | | | |
|---|---|---|---|
| 124340 | 5/1988 | Japan | 315/5.38 |
| 5021012 | 1/1993 | Japan | 315/5.38 |

*Primary Examiner*—Benny T. Lee

*Attorney, Agent, or Firm*—Terje Gudmestad; Georgann Grunebach; Michael W. Sales

[57] ABSTRACT

A collector for collecting an electron beam in a traveling wave tube is disclosed. The collector includes at least one collector stage provided with two annularly arranged stage segments. The stage segments include overlapping end portions to prevent impingement of electrons of the electron beam against an isolator surrounding the collector stage. The stage segments facilitate the realization of transverse electric field distributions from one stage segment to the other stage segment within the collector by application of selected voltages to the stage segments.

12 Claims, 4 Drawing Sheets

TRANSVERSE FIELD COLLECTOR FOR A TRAVELING WAVE TUBE

TECHNICAL FIELD

The present invention relates generally to traveling wave tubes and, more particularly, to traveling wave tube collectors.

BACKGROUND ART

An exemplary traveling wave tube (TWT) 20 is illustrated in FIG. 1. The elements of TWT 20 are generally coaxially arranged along a TWT axis 22. They include an electron gun 24, a slow wave structure (SWS) 26 (embodiments of which are shown in FIGS. 2*a* and 2*b*), a beam focusing arrangement 28 which surrounds SWS 26, a microwave signal input port 30 and a microwave signal output port 32 which are coupled to opposite ends of SWS 26, and a collector 34. A housing 36 is typically provided to protect the TWT elements.

In operation, a beam of electrons is launched from electron gun 24 into SWS 26 and is guided through the SWS by beam focusing arrangement 28. A microwave input signal 38 is inserted at input port 30 and moves along SWS 26 to output port 32. SWS 26 causes the phase velocity (i.e., the axial velocity of the signal's phase front) of the microwave signal to approximate the velocity of the electron beam.

As a result, the beam's electrons are velocity-modulated into bunches which overtake and interact with the slower microwave signal. In this process, kinetic energy is transferred from the electrons to the microwave signal; the signal is amplified and is coupled from output port 32 as an amplified microwave output signal 40. After their passage through SWS 26, the beam's electrons are collected in collector 34.

Beam focusing arrangement 28 is typically configured to develop an axial magnetic field. A first configuration includes a series of annular, coaxially arranged permanent magnets 42 which are separated by pole pieces 44. Magnets 42 are typically arranged so that adjacent magnet faces have the same magnetic polarity. This beam focusing arrangement is comparatively light weight and is generally referred to as a periodic permanent magnet (PPM). In TWTs in which output power is more important than size and weight, a second beam focusing configuration often replaces the PPM with a solenoid 46 (partially shown adjacent input port 30) which carries a current supplied by a solenoid power supply (not shown).

As shown in FIGS. 2*a* and 2*b*, SWSs generally receive an electron beam 48 from electron gun 24 into an axially repetitive structure. A first exemplary SWS is helix member 50 shown in FIG. 2*a*. A second exemplary SWS is coupled cavity circuit 52 shown in FIG. 2*b*. Coupled cavity circuit 52 includes annular webs 54 which are axially spaced to form cavities 56. Each one of webs 54 forms a coupling hole 58 which couples a pair of adjacent cavities. Helix member 50 is especially suited for broadband applications while coupled cavity circuit 52 is especially suited for high power applications.

TWTs are capable of amplifying and generating microwave signals over a considerable frequency range (e.g., 1–90 GHz). They can generate high output powers (e.g., >10 megawatts) and achieve large signal gains (e.g., 60 dB) over broad bandwidths (e.g., >10%).

Electron gun 24, helix member 50 (with input port 30 and output port 32) and collector 34 of TWT 20 illustrated in FIG. 1 are again shown in the TWT schematic of FIG. 3 (for clarity of illustration, SWS 26 is not shown in the schematic). Electron gun 24 has a cathode 60 and an anode 62. Collector 34 has a first annular stage 64, a second annular stage 66 and a third stage 68. Because third stage 68 generally has a cup-like or bucket-like form, it is sometimes referred to as the "bucket" or "bucket stage."

Helix member 50 and body 70 of TWT 20 are at ground potential. Cathode 60 is biased negatively by a voltage $V_{cath}$ from a cathode power supply 72. An anode power supply 74 is referenced to cathode 60 and applies a positive voltage + to anode 62. This positive voltage establishes an acceleration region 76 between cathode 60 and anode 62. Electrons are emitted by cathode 60 and accelerated across acceleration region 76 to form electron beam 48.

As described above with reference to FIG. 1, electron beam 48 travels through helix member 50 and exchanges energy with a microwave signal which travels along the helix member from input port 30 to output port 32. Only a portion of the kinetic energy of electron beam 48 is transferred in this energy exchange. Most of the kinetic energy remains in electron beam 48 as it enters collector 34. A significant part of this kinetic energy can be recovered by decelerating the electrons before they are collected at the collector walls.

Because of their negative charge, the electrons of electron beam 48 form a negative "space charge" which would radially disperse the electron beam in the absence of any external restraint. Accordingly, beam focusing arrangement 28 (see FIG. 1) applies an axially directed magnetic field which restrains the radial divergence of electrons by causing them to spiral about electron beam 48.

However, electron beam 48 is no longer under this restraint when it enters collector 34 and, consequently, it begins to radially disperse. In addition, the interaction between electron beam 48 and the microwave signal on helix member 50 causes the beam's electrons to have a "velocity spread" as they enter collector 34 i.e., the electrons have a range of velocities and kinetic energies.

Electron deceleration is achieved by application of negative voltages to collector 34. The potential of collector 34 is "depressed" from that of TWT body 70 (i.e., made negative relative to the TWT body). The kinetic energy recovery is further enhanced by using a multistage collector, e.g., collector 34, in which each successive stage is further depressed from the body potential of $V_B$. For example, if first collector stage 64 has a potential $V_1$, second collector stage 66 has a potential $V_2$ and third collector stage 68 has a potential of $V_3$, these potentials are typically related by the equation $V_B=0>V_1>V_2>V_3$, as indicated in FIG. 3.

The voltage $v_1$ on first stage 64 is depressed sufficiently to decelerate the slowest electrons 80 in electron beam 48 and yet still collect them. If this voltage $V_1$ is depressed too far, first stage 64 repels rather than collects electrons 80. These repelled electrons may flow to TWT body 70 and reduce the TWT's efficiency. Alternatively, they may reenter the energy exchange area of helix member 50 and reduce the TWT's stability.

Similar to first stage 64, successively depressed voltages are applied to successive collector stages to decelerate (but still collect) successively faster electrons in electron beam 48, e.g., electrons 82 are collected by collector stage 66 and electrons 84 are collected by collector stage 68.

In operation, the diverging low kinetic energy electrons 80 are repelled by collector stage 66, which causes their divergent path to be modified so that they are collected on the interior face of the less depressed collector stage 64. Higher energy electrons 82 are repelled by collector stage 68, which causes their divergent paths to be modified so that they are collected on the interior face of the less depressed collector stage 66. Finally, the highest energy electrons 84 are decelerated and collected by collector stage 68. This process of improving TWT efficiency by decelerating and collecting successively faster electrons with successively greater depression on successive collector stages is generally referred to as "velocity sorting."

The efficiency gain realized by velocity sorting of electron beam 48 can be further understood with reference to current flows through collector power supply 86 which is coupled between cathode 60 and collector stages 64, 66, and 68. If the potential of collector 34 were the same as TWT body 70, the total collector electron current $I_{coll}$ would flow back to cathode power supply 72 as indicated by current 88 in FIG. 3, and the input power to TWT 20 would substantially be the product of the cathode voltage $V_{cath}$ and the collector current $I_{coll}$.

In contrast, the currents of multistage collector 34 flow through collector power supply 86. The input power associated with each collector stage is the product of that stage's current and its associated voltage in collector power supply 86. Because the voltages $V_1$, $V_2$, and $V_3$ of collector power supply 86 are a fraction (e.g., in the range of 30%–70%) of the voltage of cathode power supply 72, the TWT input power is effectively decreased.

Efficiencies of TWTs with multistage collectors are typically in the range of 25%–60%, with higher efficiency generally associated with narrower bandwidth. These efficiencies can be further improved by enhancing the velocity sorting of the collector and considerable efforts have been expended toward this goal in the areas of collector design, simulation and prototype testing.

In some collectors, velocity sorting is improved by configuring a collector stage to introduce transverse asymmetries of the electric field within that stage. These transverse asymmetries can often enhance velocity sorting by selectively moving electrons away from the electron beam's axis.

For example, some of the low kinetic energy electrons 80 in FIG. 3 may travel along the collector axis (generally, axis 22 of FIG. 1). When these electrons are repelled by the higher depressed collector stages, they may reverse their path and travel back along the collector axis into the energy exchange area of the helix member 50. A transverse asymmetry in the electric field causes these electrons to diverge from the collector axis and increase the probability that they will be collected by the collector stage 64.

Transverse field asymmetries (electric or magnetic) are conventionally realized, for example, by beveling the leading edge of first collector stage's aperture 92 or by attaching external magnets to the collector body. Although these structures can improve velocity sorting, the former cannot be easily modified and the latter is expensive, time-consuming and adds weight and parts complexity.

Because the efficiency of a collector is a function of many elements, (e.g., diameter, length and shape of each stage, spatial interrelationship of stages, stage materials and interaction variations in the SWS), even complex computer modeling does not completely predict a design's performance.

Even well-designed velocity sorting may be degraded by the introduction of unexpected asymmetries, e.g., by manufacturing tolerances. Consequently, extensive and expensive prototype testing and design modification are often required to finalize a collector design and time-consuming test adjustments (e.g., attachment of external magnets) are often required during production because of the lack of any ready means for adjusting transverse electric field distributions within a collector.

SUMMARY OF THE INVENTION

An object of the present invention is to provide a collector which enhances TWT efficiency by facilitating the selection of transverse electric field distributions within the collector.

Another object of the present invention is to provide a collector having collector stage segments for generating transverse electric field distribution within the collector to suppress the emission of secondary electrons.

A further object of the present invention is to provide a collector having collector stage segments for generating transverse electric field distribution within the collector to collect electrons of an electron beam on one side of the collector.

Still another object of the present invention is to provide a collector having collector stage segments for generating transverse electric field distributions within the collector to prevent electrons of an electron beam from being reflected.

Still a further object of the present invention is to provide a collector having collector stage segments annularly arranged with overlapping end portions such that electrons of an electron beam cannot impinge on an isolator surrounding the collector stage.

In carrying out the above objects and other objects, a traveling wave tube is provided. The traveling wave tube includes an electron gun configured to generate an electron beam. A slow wave structure is positioned so that the electron beam passes through the slow wave structure. A beam focusing structure is arranged to axially confine the electron beam within the slow wave structure. A collector having a plurality of collector stages collects the electron beam. At least one of the collector stages includes two annularly arranged stage segments which include overlapping end portions to prevent impingement of electrons of an electron beam against an isolator surrounding the collector stage. The stage segments facilitate the realization of a transverse electric field from one stage segment to the other stage segment within the collector by application of selected voltages to the stage segments.

The advantages accruing to the present invention are numerous. The transverse electric field is created by a unique combination of collector stage geometry and application of selected voltages. The transverse electric field positively suppresses the undesirable emission of secondary electrons from the collector stages. It also causes the electrons of the electron beam to be collected on one side of the collector rather than symmetrically around the collector axis which results in better control of waste heat flow in the TWT. This is particularly advantageous for TWTs cooled by conduction or radiation. Additionally, the transverse electric field insures that incoming electrons with low perpendicular velocity and unfavorable entrance trajectories are not reflected out of the collector.

These and other features, aspects, and embodiments of the present invention will become better understood with regard to the following description, appended claims, and accompanying drawings.

BEST MODES FOR CARRYING OUT THE INVENTION

Figure 1:
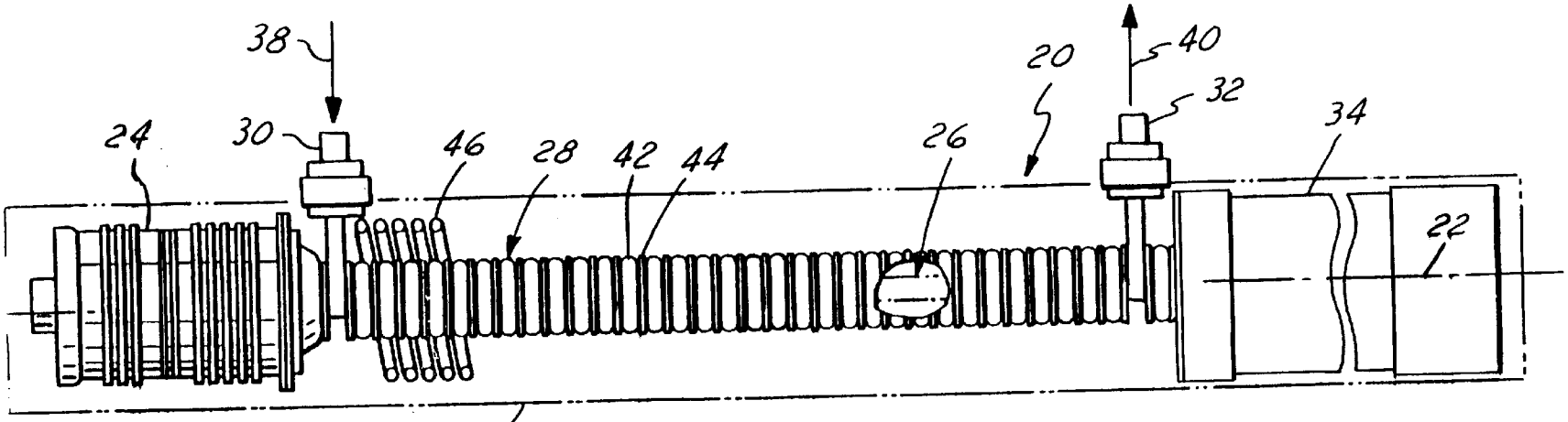
(PRIOR ART) FIG. 1
FIG. 1 is a partially cutaway side view of a conventional traveling wave tube (TWT)
Figure 2B:
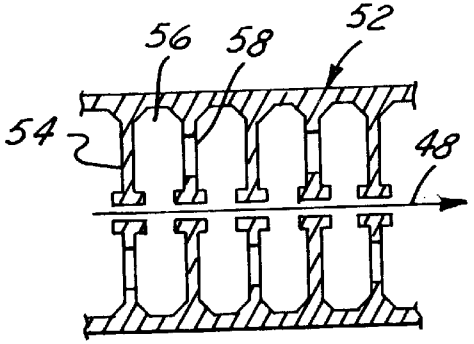
(PRIOR ART) FIG. 2B
FIG. 2B illustrates another conventional slow wave structure in the form of a coupled-cavity circuit for use in the TWT of FIG. 1.
Figure 2A:
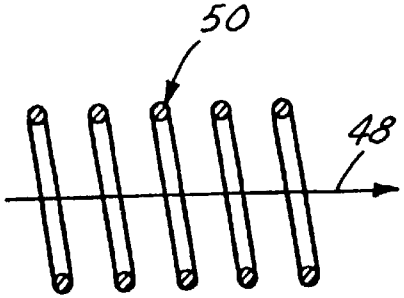
(PRIOR ART) FIG. 2A
FIG. 2A illustrates a conventional slow wave structure in the form of a helix member for use in the TWT of FIG. 1.
Figure 3:
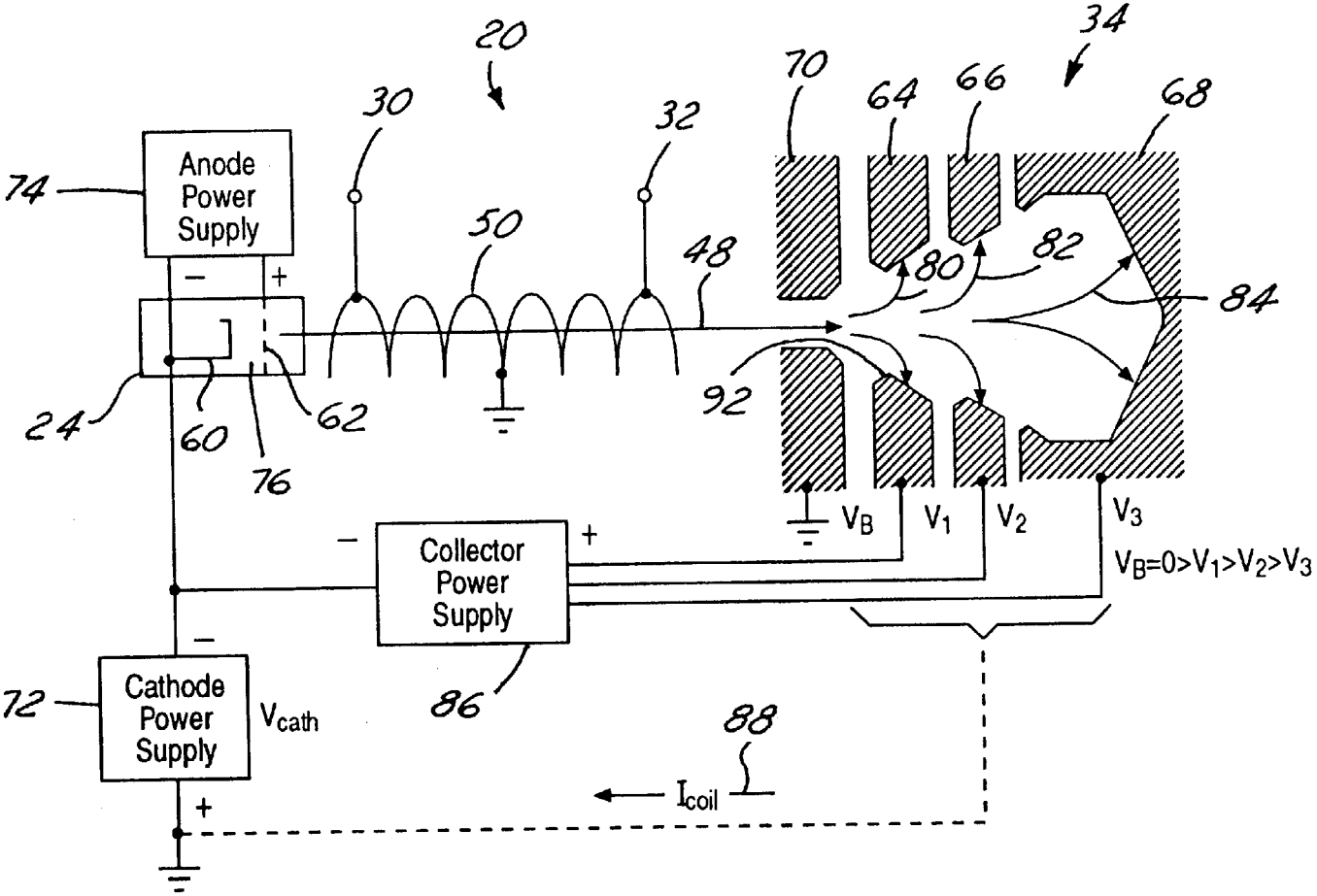
(PRIOR ART) FIG. 3
FIG. 3 is a schematic of the TWT of FIG. 1 which shows a radially sectioned, multistage collector.
Figure 4:
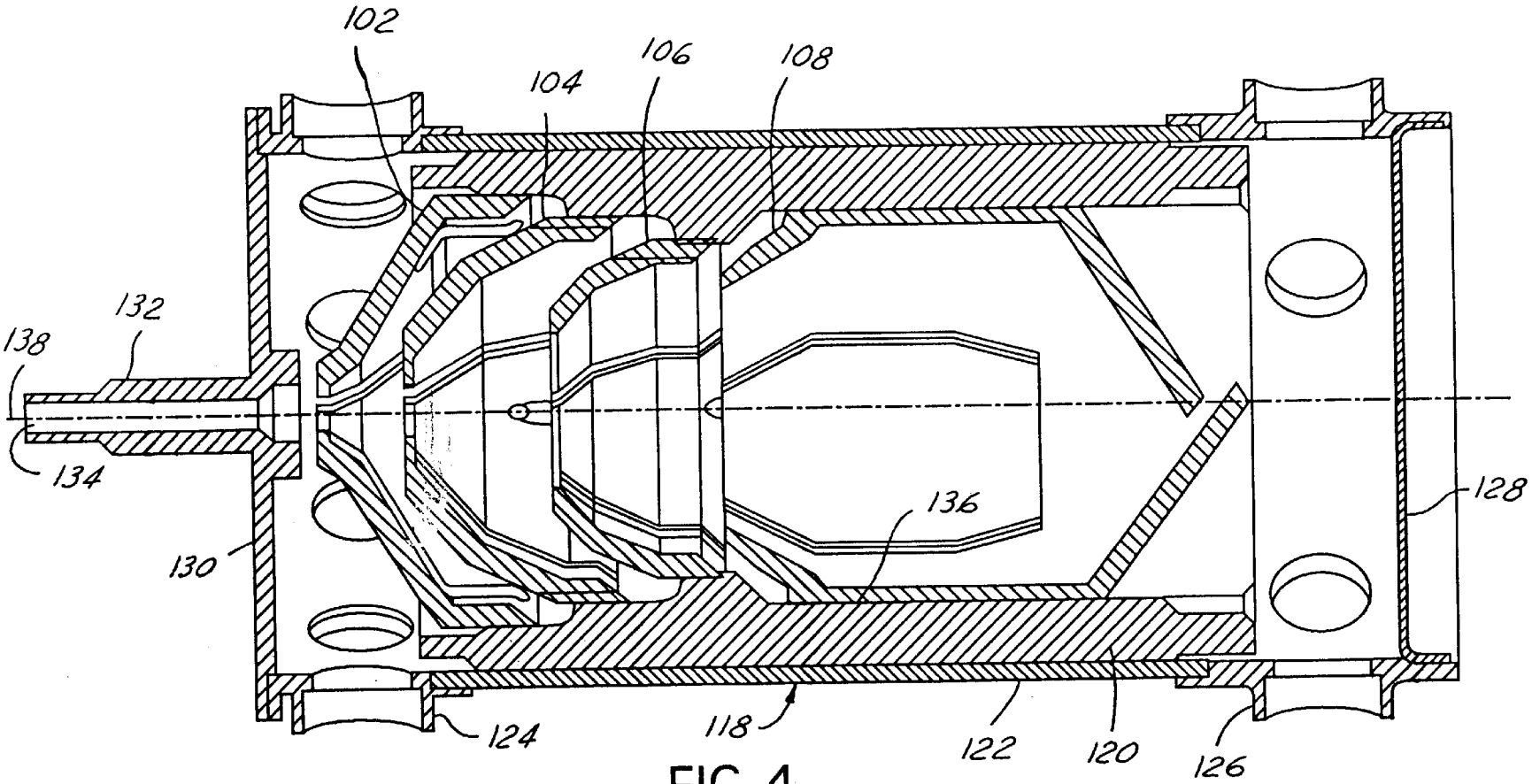
FIG. 4 is a cross sectional view of a collector in accordance with the present invention.
Figure 6:
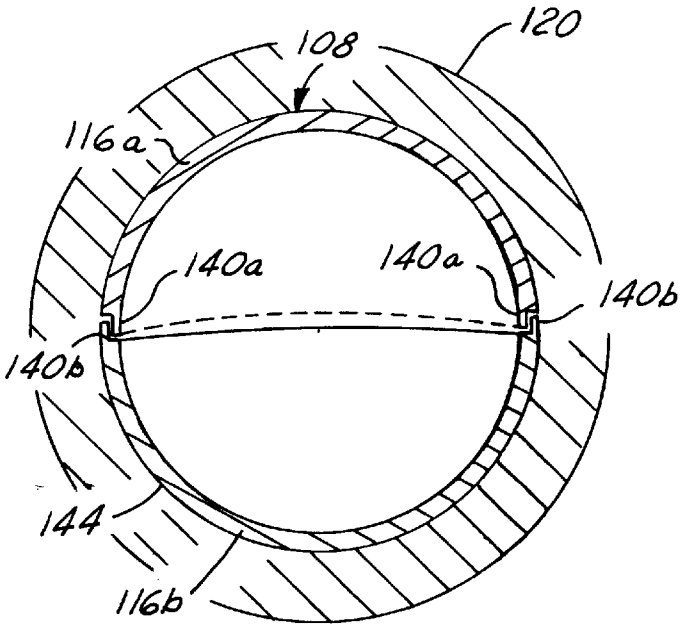
FIG. 6 is a sectional view of a collector stage and a surrounding isolator along the line 6—6 shown in FIG. 5.
Figure 5:
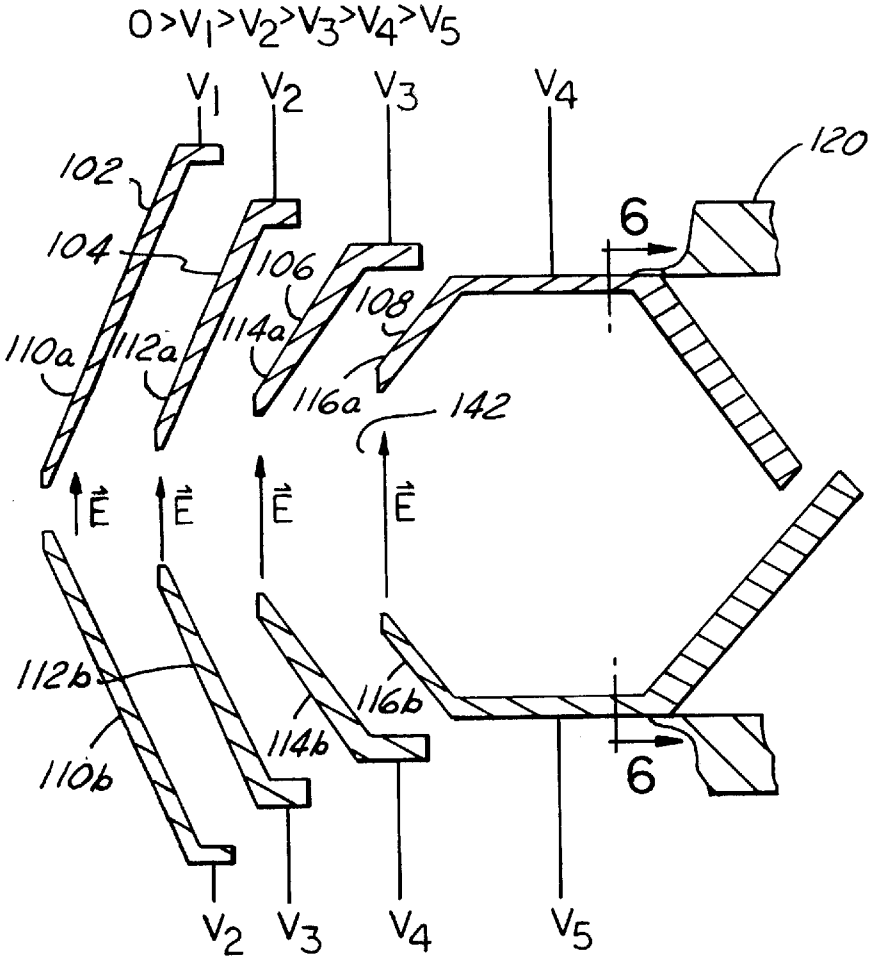
FIG. 5 is an illustration of the collector stages of the collector of FIG. 4.

Referring now to FIGS. 4, 5, and 6, a collector 100 (see FIG. 4) according to the present invention is shown. Collector 100 is suitable for use with a TWT such as TWT 20 shown in FIG. 1. Collector 100 includes annular collector stages 102, 104, 106, and 108. If desired, collector 100 may include more annular collector stages. Collector stages 102, 104, 106, and 108 are each formed with two annularly arranged stage segments 110(*a,b*), 112(*a,b*), 114(*a,b*) and 116(*a,b*), respectively as seen in FIG. 5. In essence, each collector stage is a one piece collector stage that has been cut or split into two segments along a plane containing an axis of revolution.

Selected transverse electric field distributions can be realized within each of collector stages 102, 104, 106, and 108 by applying selected voltages to the segments of these stages. Selected axial electric field distributions can be realized by applying selected voltages to collector stages 102, 104, 106, and 108. These selected transverse and axial electric fields can be readily combined to enhance the velocity sorting of collector 100.

As best seen in FIG. 4, collector 100 has an annular collector body 118 and an annular ceramic isolator 120 which is positioned within the collector body. Collector body 118 is formed with an annular sleeve 122, a first annular sleeve end 124, a second annular sleeve end 126, a cylindrical cap 128, and an annular disk 130 which extends axially as a tube 132 with an axially aligned passage 134. Isolator 120 forms a plurality of concentric, annular faces having different radii on its interior surface, e.g., face 136.

The elements of collector 100 are coaxially assembled about a common collector axis 138 (see FIG. 4). Stage segments 110(*a,b*), 112(*a,b*), 114(*a,b*), and 116(*a,b*) are preferably positioned along collector axis 138 opposite from one another. However, if desired, stage segments 110(*a,b*), 112(*a,b*), 114(*a,b*), and 116(*a,b*) may be positioned along a collector axis 138 axially offset from one another.

First and second sleeve ends 124 and 126 are connected to opposite ends of sleeve 122, cap 128 is connected to second sleeve end 126 and disk 130 is connected to first sleeve end 124, with tube 132 extending away from sleeve 122. When installed in a TWT such as TWT 20 of FIG. 1, collector body 118 forms part of the TWT's vacuum envelope. Accordingly, the elements of collector body 118 are preferably formed of a metal, e.g., copper, and permanently joined together, e.g., by brazing.

Isolator 120 is positioned within collector body 118 and collector stages 102, 104, 106, and 108 are positioned within respective annular faces, e.g., face 136 of isolator 120. Isolator 120 electrically isolates the collector stages and radially conducts heat (generated, for example, by the kinetic energy loss of the electron beam) to collector body 118. Collector stages 102, 104, 106, and 108 are positioned in a coaxial relationship.

Collector stages 102, 104, 106, and 108 are preferably formed of a material, e.g., graphite or copper, per, which has low electrical and thermal resistances. Because isolator 120 electrically isolates the collector stages from collector body 118 and transfers heat from collector stages 102, 104, 106, and 108 to collector body 118, it is preferably formed of a ceramic such as alumina or beryllia. Isolator 120 and collector stages 102, 104, 106, and 108 can be assembled into collector body 118 with an interference fit. Preferably, they are brazed in place (the brazing can be facilitated by first applying a metallic coating to isolator 120).

Each of collector stages 102, 104, 106, and 108 is formed with annularly arranged segments. This structure is exemplified by the sectional view of fourth collector stage 108 shown in FIG. 6. FIG. 6 is a view looking into collector 100 along the line 6—6 of FIG. 5. Collector stage 108 has two stage segments 116(*a,b*). Stage segments 116(*a,b*) form a segmented collector aperture 142 (see FIG. 5) and a segmented collector perimeter 144. Stage segments 116(*a,b*) are physically separated from one another such that there is no electric current path between them. Thus, selected voltages may be applied to each of stage segments 116(*a,b*) to generate a transverse electric field from one of the stage segments to the other stage segment.

Stage segments 116(*a,b*) include end portions 140(*a,b*) which overlap one another to form an S shape as shown in FIG. 6. Ceramic from isolator 120 (see FIG. 4) or other types of insulators may be positioned within the volume formed by the S shape to electrically isolate the two stage segments 116(*a,b*). The end portions overlap, without touching each other, to prevent electrons of the electron beam from impinging upon, and electrically charging, isolator 120. In essence, the electrons have no direct travel path toward isolator 120. This is advantageous because electron impingement upon the ceramic of isolator 120 is a potentially serious cause of spurious shut offs in TWTs.

Voltages V1, V2, V3, V4, and V5 (where 0>V1 >V2>V3>V4>V5) may be connected as shown in FIG. 5 to stage segments 110(*a,b*), 112(*a,b*), 114(*a,b*) and 116(*a,b*) in an alternating or staggered fashion to generate transverse electric fields from one stage segment to the other stage segment of a collector stage. The transverse electric fields ($\overline{E}$) between the respective stage segments are indicated as shown in FIG. 5. This voltage pattern applied to the stage segments converts collector 100 to a five stage collector even though it has only four collector stages.

Of course, other types of voltage patterns may be used depending upon the characteristics of the electron beam entering collector 100. For instance, voltages V3, V4, V5, and V6 (where V5>V6) instead of voltages V2, V3, V4, and V5 may be applied to stage segments 110*b*, 112*b*, 114*b*, and 116*b*. In this case, collector 110 is converted to a six stage collector even though it has only four collector stages.

Generating transverse electric fields by applying selected voltages to the stage segments results in many benefits. First, the transverse electric field from one stage segment to the other stage segment of a collector stage suppresses the undesirable emission of secondary electrons from the collector stage. This is important because when incoming electrons land on a stage segment they generate multiple secondary electrons. If these electrons are not recollected by the stage segment from which they were emitted, then a net flow of unwanted current occurs and the efficiency of the collector decreases.

Second, the transverse electric field between the stage segments enables the preferential collection of the electron beam on one side of the collector rather than symmetrically about the collector axis. Thus, the flow of waste heat can be more effectively controlled. For instance, a conduction cooled collector could be arranged to deflect the electron beam to the side of the collector closest to a baseplate of the TWT. A radiation cooled collector for use on board a spacecraft could be arranged to deflect the electron beam to the side of the collector closest to deep space and have a radiator to preferentially radiate the waste heat in a certain direction away from the spacecraft.

Third, a further advantage accrues from the presence of the transverse electric field when collecting certain incoming electrons that have low ratios of perpendicular to parallel velocities and unfavorable entrance trajectories into the collector. With typical collectors, some of these electrons are not captured on the stage which should collect them in order to recover the most kinetic energy. Instead they are reflected and fall back to either a lower voltage potential stage or exit the collector completely. The transverse electric field of the collector of the present invention forces all incoming electrons off axis to prevent any of these electrons from being reflected.

As shown, the collector of the present invention has many attendant advantages and is suitable for all TWTs. It is especially relevant to space satellites which use TWTs as output amplifiers.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and scope of the appended claims.

What is claimed is:

1. A collector for collecting an electron beam in a traveling wave tube comprising:

at least one collector stage split along a plane containing an axis of revolution into two separated annularly arranged stage segments positioned along a common collector axis, the two stage segments being provided with overlapping end portions to prevent impingement of the electrons of an electron beam against an isolator surrounding the at least one collector stage, wherein the overlapping end portions define an S shape configuration, wherein the two stage segments facilitate the realization of transverse electric field distributions from one of the two stage segments to the other of the two stage segments within the collector by application of selected voltages to the two stage segments.

2. The collector of claim 1 wherein:

the two stage segments are axially offset from one another along the common collector axis.

3. A traveling wave tube comprising:

an electron gun configured to generate an electron beam;

a slow wave structure positioned so that the electron beam passes through the slow wave structure;

a beam focusing structure arranged to axially confine the electron beam within the slow wave structure; and a collector having a plurality of collector stages for collecting the electrons of the electron beam, wherein at least one of the plurality of collector stages is split along a plane containing an axis of revolution into two separated annularly arranged stage segments positioned along a common collector axis, the two stage segments being provided with overlapping end portions to prevent impingement of electrons in the electron beam against an isolator surrounding the plurality of collector stages, wherein the overlapping end portions define an S shape configuration, wherein the two stage segments facilitate the realization of transverse electric field distributions from one of the two stage segments to the other of the two stage segments within the collector by application of selected voltages to the two stage segments.

4. The traveling wave tube of claim 3 wherein:

the beam focusing arrangement is a periodic permanent magnet arrangement.

5. The traveling wave tube of claim 3 wherein:

the realization of transverse electric field distributions from one of the two stage segments to the other of the two stage segments within the collector providing for suppressing the undesirable emission of secondary electrons form the at least one collector stage.

6. The traveling wave tube of claim 3 wherein:

the realization of transverse electric field distributions from one of the two stage segments to the other of the two stage segments within the collector providing for collecting the electron beam on one side of the collector.

7. The traveling wave tube of claim 3 wherein:

the realization of transverse electric field distributions from one of the two stage segments to the other of the two stage segments within the collector providing for forcing incoming electrons off the common collector axis to prevent any of these electrons from being reflected.

8. The traveling wave tube of claim 3 wherein:

the two stage segments are axially offset from one another along the common collector axis.

9. The traveling wave tube of claim 3 wherein:

the plurality of collector stages are coaxially arranged about the common collector axis at a different axial position along the common collector axis to facilitate the realization of selected axial electric field distributions within the collector by application of the selected voltages to the plurality of collector stages.

10. The traveling wave tube of claim 3 wherein:

the plurality of collector stages includes at least two collector stages.

11. The traveling wave tube of claim 3 wherein:

the slow wave structure is a helix member.

12. The traveling wave tube of claim 3 wherein:

the slow wave structure is a coupled-cavity circuit.

* * * * *